US005207843A

United States Patent [19]

Maloney et al.

[11] Patent Number: 5,207,843

[45] Date of Patent: May 4, 1993

[54] CHROMIUM HOT WORK STEEL

[75] Inventors: James L. Maloney, Greensburg; William P. Edwards, Ligonier; Mark S. Rodney, Pittsburgh, all of Pa.

[73] Assignee: Latrobe Steel Company, Latrobe, Pa.

[21] Appl. No.: 738,805

[22] Filed: Jul. 31, 1991

[51] Int. Cl.[5] ..... C21D 8/00

[52] U.S. Cl. ..... 148/540; 148/546; 148/333; 148/334; 420/105; 420/110; 420/111

[58] Field of Search ..... 148/12 F, 333, 334, 148/2, 546, 540; 420/105, 110, 111

[56] References Cited

U.S. PATENT DOCUMENTS

| | | | |
|---|---|---|---|
| 2,793,113 | 5/1957 | Rait et al. | 75/128 |
| 3,183,127 | 5/1965 | Gregory et al. | 148/31 |
| 3,431,101 | 3/1969 | Kunitake et al. | 75/124 |
| 3,602,689 | 8/1971 | Heuschkel | 219/137 |
| 3,656,943 | 4/1972 | Heuschkel | 75/128 A |
| 4,116,684 | 9/1978 | Uchida et al. | 75/126 C |
| 4,121,929 | 10/1978 | Kawai et al. | 75/238 |
| 4,121,930 | 10/1978 | Yukawa et al. | 75/238 |
| 4,224,060 | 9/1980 | de Souza et al. | 75/124 |
| 4,468,249 | 8/1984 | Lehman | 75/124 |
| 4,650,645 | 3/1987 | Kato et al. | 420/111 |
| 4,729,872 | 3/1988 | Kishida et al. | 420/105 |
| 4,780,139 | 10/1988 | Hellman et al. | 75/240 |
| 4,842,816 | 6/1989 | Miyasaka et al. | 420/84 |
| 4,853,181 | 8/1989 | Wert et al. | 420/111 |
| 4,863,515 | 9/1989 | Roberts et al. | 75/238 |
| 4,880,461 | 11/1989 | Uchida | 75/238 |
| 4,936,911 | 6/1990 | Roberts et al. | 75/238 |
| 4,957,701 | 9/1990 | Masuyama et al. | 420/69 |

FOREIGN PATENT DOCUMENTS

| | | | |
|---|---|---|---|
| 2039438 | 2/1972 | Fed. Rep. of Germany | 420/111 |
| 1174491 | 8/1985 | U.S.S.R. | 148/334 |

OTHER PUBLICATIONS

Table 1 in the Metals Handbook, 9th Edition, p. 422 vol. 3, 1979.

"Alloy Partitioning and Grain Growth Control of H13 Steel" Published by ASM in abstract form Sep. 1988 Jose R. T. Branco and George Krauss.

*Primary Examiner*—H. Dean

*Assistant Examiner*—Sikyin Ip

*Attorney, Agent, or Firm*—Webb, Burden, Ziesenheim & Webb

[57] ABSTRACT

A modified H-13 hot work die steel in which impact toughness and thermal fatigue resistance is greatly improved. The steel consists of in weight %:

| | |
|---|---|
| Carbon (C): | 0.34–0.40, |
| Manganese (Mn): | 0.25–0.45, |
| Silicon (Si): | 0.85–1.15, |
| Chromium (Cr): | 5.00–5.40, |
| Nickel (Ni): | 0.30 max, |
| Molybdenum (Mo): | 1.20–1.50, |
| Vanadium (V): | 0.31–0.52, |
| Niobium (Nb): | 0.02–0.09, |
| Iron (Fe) and Incidental impurities: | Balance |

The steel also preferably includes about 0.01–0.20 weight % titanium (Ti) and is preferably subjected to premium quality treatment, including remelting and homogenization, either thermal or mechanical (by hot working).

11 Claims, 6 Drawing Sheets

CHROMIUM HOT WORK STEEL

BACKGROUND OF THE INVENTION

The present invention relates generally to tool steels for hot and cold work applications and, more particularly, to an improved chromium hot work die steel of the AISI/SAE type H-13 possessing high impact toughness and thermal fatigue resistance. The improved alloy of the present invention is particularly suitable for use as a die steel in aluminum die casting, for example. Other hot work applications for the improved steel of the present invention include extrusion dies for aluminum and magnesium, dummy blocks and mandrels for brass and aluminum extrusion, hot press dies, punches and dies for shell piercing, die inserts for forging dies, hot shear blades to mention a few. Cold work applications for the present invention include cold heading dies, intermediate rolls for use on a Sendzimir mill and the like.

Heretofore, a commonly used hot work steel for such applications has been standard type H-13 having the following chemistry, in weight %, as published in the *Metals Handbook,* Ninth Ed., Volume 3, page 422: 0.32–0.45 C; 0.20–0.50 Mn; 0.080–1.20 Si; 4.75–5.50 Cr; 0.30 max Ni; 1.10–1.75 Mo and; 0.80–1.20 V. While H-13 steel has found extensive use as a hot die material due to its elevated temperature hardness and strength properties, it does fall victim to a shortened service life caused by brittle failure and/or thermal fatigue. The dies used in pressure die casting of aluminum, for example, are subject to thermal cycling resulting from constant heating and cooling during operation at temperatures up to about 900° to 1,000° F. It is sometimes necessary to slow the production rate in order to prevent overheating of conventional die steel material such as H-13. The casting dies are also subject to significant loading during use at such elevated temperatures, which provides an ideal condition for brittle failure to take place. In addition, the vanadium alloy constituent in conventional H-13 steel is rather costly and subject, in recent times, to wide price fluctuations, making vanadium a significant factor in the cost of H-13 steel.

Prior attempts have been made to partially or fully substitute niobium for vanadium in H-13 to control grain size, but these have not proven successful in large production heats due to the formation of large niobium carbide particles which are harmful to high temperature properties and grain size.

It is, therefore, an object of the present invention to provide an improved H-13 type steel with greatly improved impact toughness and resistance to thermal fatigue or heat check resistance while maintaining comparable elevated temperature hardness and strength characteristics of conventional and premium grade H-13 steels. In addition, the present invention exhibits such improved properties while significantly reducing the amount of the expensive vanadium alloy previously required in H-13 steel. A process according to the present invention provides a more homogeneous microstructure which still further increases the toughness as well as the heat check resistance of the material. The resulting hot work die steel of the invention provides in die casting operations increased production rates as well as increased tool life over conventional die steels.

SUMMARY OF THE INVENTION

Briefly stated, the present invention is an improved chromium hot work steel, composition and method of processing same to develop a homogeneous microstructure and superior properties. The improved steel composition of the present invention consists of, in weight %, about 0.32–0.45 carbon (C); about 0.20–0.50 manganese (Mn); about 0.80–1.20 silicon (Si); about 4.75–5.50 chromium (Cr); about 1.10–1.75 molybdenum (Mo); about 0.30–0.55 vanadium (V); about 0.02–0.09 niobium (Nb); balance iron (Fe). In a further preferred embodiment of the invention, a further addition of about 0.01 weight %–0.20 weight % titanium (Ti) is present in the composition. A preferred composition consists essentially of in weight % about 0.37 C; about 1.00 Si; about 0.40 Mn; about 0.001 sulphur (S); about 5.30 Cr; about 1.35 Mo; about 0.38 V; about 0.035 Nb; balance iron and incidental impurities. A further preferred composition consists essentially of the above recited constituents and, in addition, preferably about 0.03 weight % Ti.

A method according to the present invention comprises the steps of providing an alloy having a controlled chemistry as set forth above and including the subsequent steps of electroslag remelting and subjecting the remelted material to a thermal or mechanical (by hot working) homogenization treatment. The homogeneous microstructure produced thereby greatly enhances the impact toughness properties of the material. The steel is also preferably subjected to a conventional argon-oxygen decarburization (AOD) refining treatment during initial melting.

DETAILED DESCRIPTION OF THE INVENTION

Figure 1:
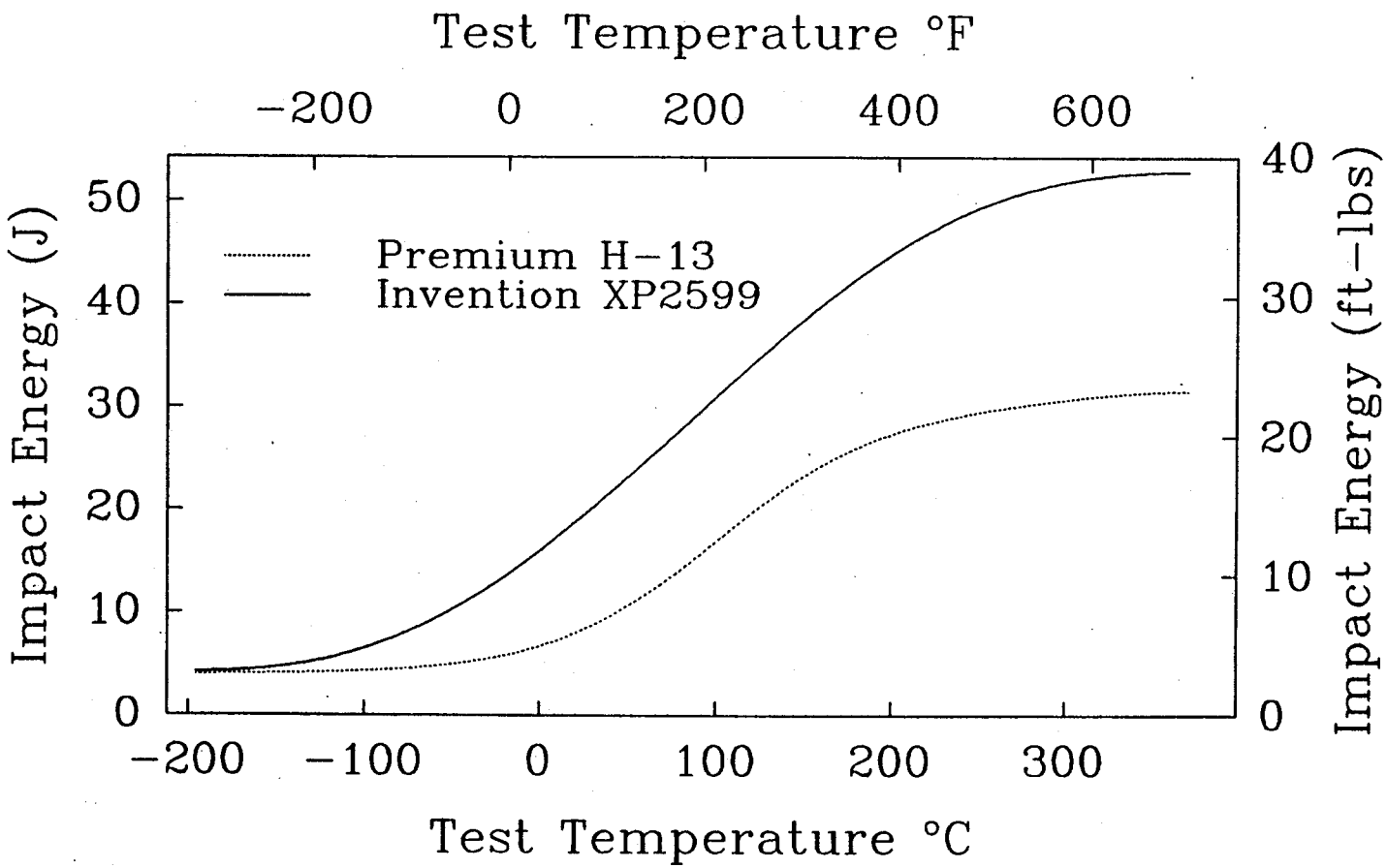
FIG. 1 is a graph of impact strength versus temperature of the steel of the present invention, designated XP-2599, and a conventional premium quality H-13 steel.

One important aspect of the present invention resides in the discovery that the impact toughness and resistance to thermal fatigue or heat check resistance in a conventional AISI/SAE type H-13 chromium hot work steel can be greatly increased by selective chemistry modification and further enhanced by special processing.

Standard H-13 steel commonly has a vanadium content of about 1% which precipitates out of solution after heat treating in the form of a dispersion of secondary vanadium carbide particles. The dispersion of vanadium carbide is believed to be beneficial in providing improved elevated temperature hardness or so-called hot hardness. We have discovered that when niobium is partially substituted for vanadium in micro alloying amounts of about 0.02–0.09 weight % niobium and, more preferably, about 0.02–0.04 weight % niobium, that the high temperature toughness and heat check resistance of the resultant material is significantly improved without any decrease in hot hardness properties. The material also exhibits tempering properties comparable with those of conventional H-13 steel.

It is believed that carefully controlled additions of niobium in amounts of preferably below 0.05 weight % and most preferably about 0.035 weight % will result in the formation of small sized niobium carbide particles which are present as a fine dispersion in the steel. The fine precipitated niobium carbide particles are believed to pin the grain boundaries and prevent grain growth at elevated temperatures. High temperature properties such as hot hardness are thus maintained, along with the additional surprising properties of greatly enhanced impact toughness and thermal fatigue resistance.

We believe that it is necessary to closely control the niobium content to the lower levels discussed above so as to avoid the formation of large niobium carbide particles in the matrix. Such large niobium carbide particles are thought to form crack initiation sites which lowers the impact toughness of the material.

The lowering of the vanadium content from about 1.0% in conventional H-13 to 0.31–0.52% and preferably to about 0.38% in the invention eliminates a substantial number of primary vanadium carbide particles from the matrix. This lowered vanadium content therefore decreases the number of potential crack initiation sites and, thus, also improves high temperature impact toughness in the material of the invention compared with prior H-13 steels. At the preferred vanadium content of about 0.38%, most of the vanadium will remain in solution and, therefore, will not appear to any significant extent as primary vanadium carbides.

The carbon (C) content of the present invention is critical for forming the necessary carbides which provide, among other things, high hardness and grain size control. The carbon is preferably controlled between about 0.32–0.45 weight % and more preferably held at about 0.37 weight %.

Manganese (Mn) is effective in increasing the hardenability of the steel as well as to getter the sulfur to eliminate the risk of sulfur diffusing to grain boundaries and cause severe weakening. Manganese is preferably present in an amount from about 0.20–0.50 weight % and more preferably is held at about 0.40 weight %.

Silicon (Si) is employed for its ability to greatly improve the tempering characteristics of the steel. Silicon is preferably present in an amount from about 0.80–1.20 weight % and more preferably held at about 1.00 weight %.

Chromium (Cr) is essential in this class of steel for its capability to enhance elevated temperature properties as well as minor contributions to abrasion resistance and hardenability. Chromium is present in a preferable range of about 4.75–5.50 weight % and more preferably held at about 5.30 weight %.

Molybdenum (Mo) is very effective for its ability to increase the strength of the steel by precipitation of a fine dispersion of small molybdenum carbides. It also is very effective at increasing the hardenability of the steel and its tempering resistance. Molybdenum is present in a preferable range of from about 1.10–1.75 weight % and more preferably held at about 1.35 weight %.

Vanadium (V) as discussed above, combines with carbon to form vanadium carbides as a finely dispersed precipitate in amounts over about 0.38 weight %. Preferably, the vanadium content is controlled between about 0.31 and 0.52 weight % and more preferably held at about 0.38 weight %. Vanadium is beneficial for providing improved hot hardness properties.

Niobium (Nb), discussed above, is employed as a partial substitution for vanadium and also combines with carbon to form a fine dispersion of niobium carbonitrides. The niobium addition is beneficial for its ability to pin grain boundary movement to control grain size and further increase impact toughness. Niobium in carefully controlled micro-alloying amounts is employed within the gross range of about 0.02–0.09 weight % and preferably below 0.05 weight % to avoid the formation of large eutectic niobium carbide particles which are deleterious to impact toughness properties and deplete the niobium available to form carbonitrides for grain size control. Most preferably, the niobium is held at about 0.035 weight %.

We have also found that titanium (Ti) when added to the alloy of the present invention further improves the already enhanced impact toughness properties. Titanium alters the activity of the carbon and nitrogen in the liquid metal to an extent whereby niobium does not form large niobium carbide or niobium carbonitride particles. Titanium is also effective in providing a more even distribution of small molybdenum carbide particles. Titanium additions are preferably controlled within a range of about 0.01–0.20 weight % and most preferably held at about 0.03 weight %.

EXAMPLE 1

A commercial size heat of 30 tons of steel, formulated according to the present invention, was melted and was analyzed as follows, in weight %: carbon (C) 0.37; silicon (Si) 1.00; manganese (Mn) 0.40; sulphur (S) 0.001; chromium (Cr) 5.30; molybdenum (Mo) 1.35; vanadium (V) 0.38; and niobium (Nb) 0.05.

The material was air melted, AOD refined, and a portion was processed in the same manner as H-13 which consists of hot working and annealing. The balance of the air melted, AOD refined material was additionally processed in accordance with a treatment method according to the invention in order to further enhance the high temperature properties thereof. This further treatment included the steps of remelting of the air melted material and homogenization. Remelting followed by thermal or mechanical homogenization of the metallurgical structure greatly increases the impact toughness and is believed to increase heat checking resistance of the material. The homogenized material is then hot worked by conventional hot working practices (forging) to achieve the desired reduction ratio and size. The resultant commercial product is referred to as "premium quality" grade.

Room temperature tensile measurements set forth in Table I were made on the air cast material designated A and on the air cast/remelted and homogenized (premium quality) material designated B therein. Both materials A and B were from the same heat having a chemistry according to the present invention, as set forth above.

All samples set forth in Table I were 0.252" diameter tensiles and tested in accordance with ASTM E8-89. All samples were austenitized at 1850° F., air cooled and double tempered to the indicated hardness. Each value is the average of two samples tested in the longitudinal direction.

TABLE I

ROOM TEMPERATURE TENSILE DATA

| Material | Hardness HRC | Ultimate Tensile Strength MPA (Ksi) | Yield Strength MPa (Ksi) | % Elongation | % Reduction of Area |
|---|---|---|---|---|---|
| A | 44 | 1,505 (218.3) | 1,284 (186.2) | 13.0 | 38.4 |
| B | 45 | 1,534 (222.5) | 1,301 (188.7) | 15.5 | 42.6 |
| B | 39.8 | 1,376 (199.6) | 1,140 (165.4) | 13.5 | 45.2 |
| B | 48.7 | 1,757 (254.8) | 1,477 (214.3) | 13.0 | 44.6 |

The table indicates high tensile strengths for both the air melted and remelted and homogenized materials. The post treated material B, however, exhibited superior ductility at high hardness and strength levels over material A.

A graphic comparison of the impact properties of the steel of the present invention and a conventional, premium quality H-13 steel is set forth in FIG. 1. Both steels received a post air cast treatment wherein the materials were remelted and homogenized (premium quality). The curves in FIG. 1 indicate that the impact strength of the steel of the invention is substantially greater than the H-13 steel over the range from −200° C. to 400° C. with the greater divergence occurring as the temperature exceeds about 200° C. This increased impact strength makes the material of the invention particularly well suited as a hot work die steel possessing toughness, heat check resistance and superior ductility throughout large sections. Such properties permit increased production rates in die casting operations, as well as increased tool life compared with prior H-13 steel.

Figure 2:
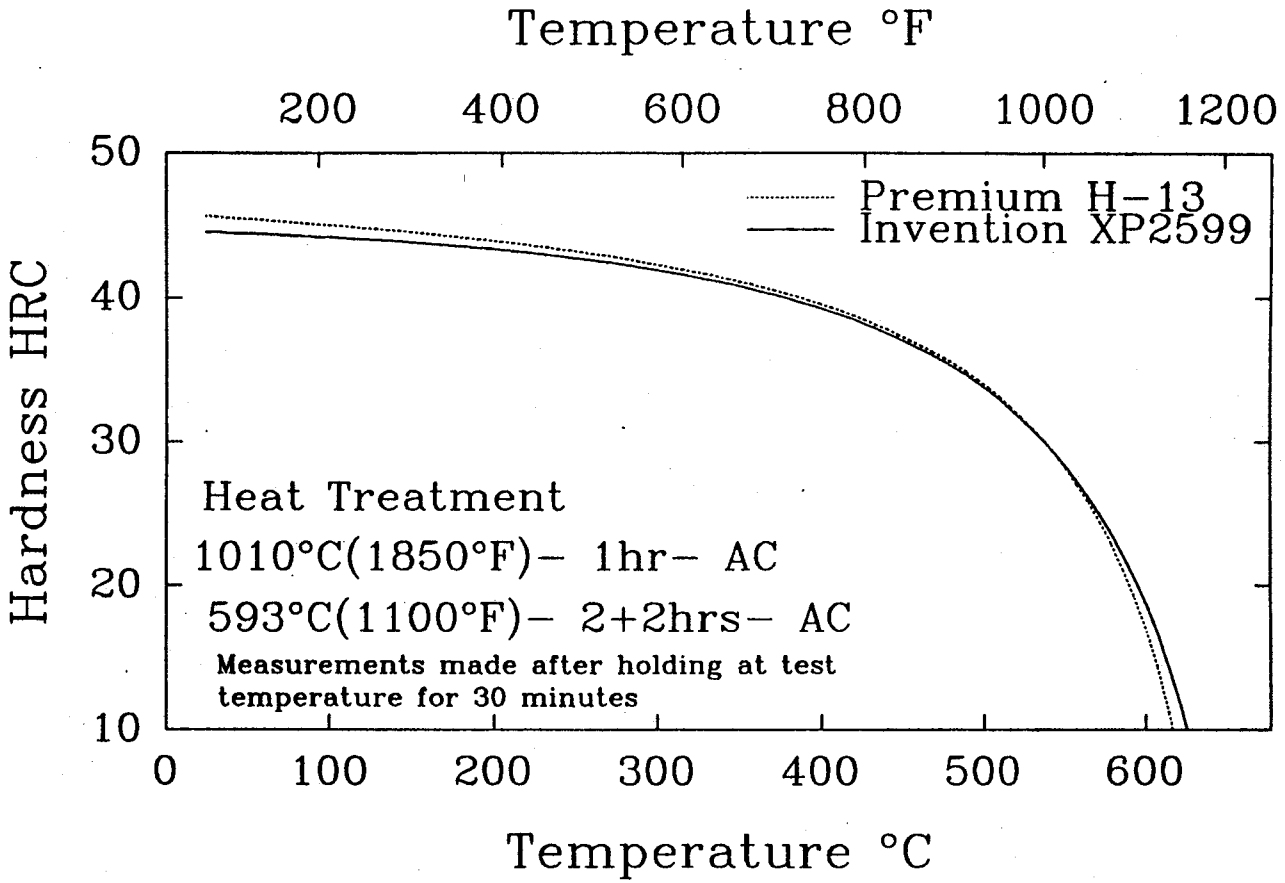
FIG. 2 is a comparative graph of hardness versus temperature of a steel of the present invention versus a conventional premium quality H-13 steel.

FIG. 2 graphically depicts the hardness in HRC (Rockwell "C") of a steel of the present invention designated "Invention XP-2599" and a premium quality H-13 showing comparable hot hardness values for each. The hot hardness of the materials remains at about 30 Rockwell C at 1000° F., the upper operating temperature of an aluminum die casting die, for example. This hot hardness value is excellent for die materials which must maintain such hardness/strength levels to avoid premature failure. FIG. 2 further demonstrates that the lower vanadium content of the steel of the invention in combination with the controlled niobium addition does not result in any degradation of hot hardness properties compared with conventional premium quality H-13.

Figure 3:
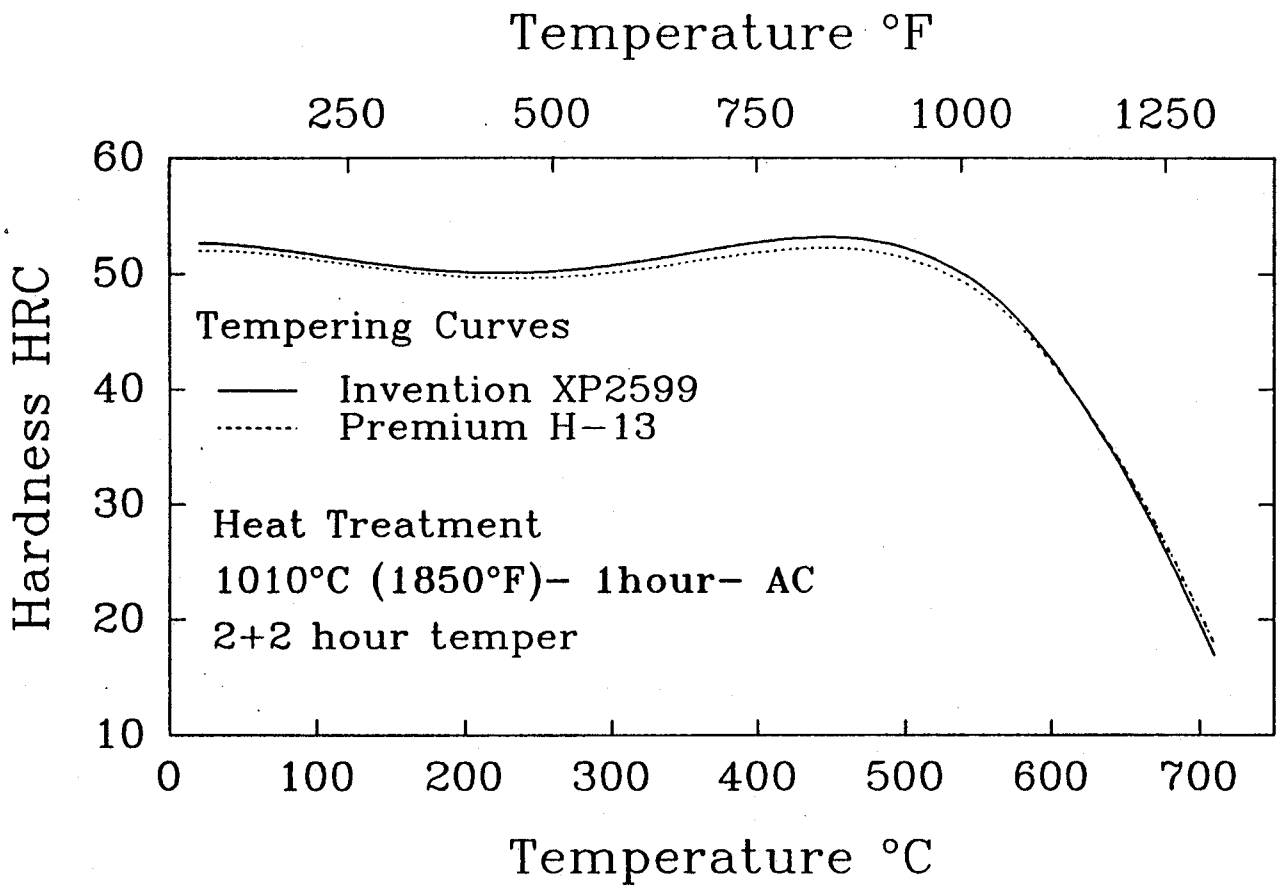
FIG. 3 is a graphical representation of the tempering curves for a steel composition of the invention and a premium quality H-13 steel.

FIG. 3 further demonstrates the similarity in the tempering curves of the steel of the invention and that of conventional premium quality H-13 hot work steel. This is advantageous for heat treaters of H-13 as little or no change will be necessary to process Invention XP-2599 along side H-13.

Figure 4:
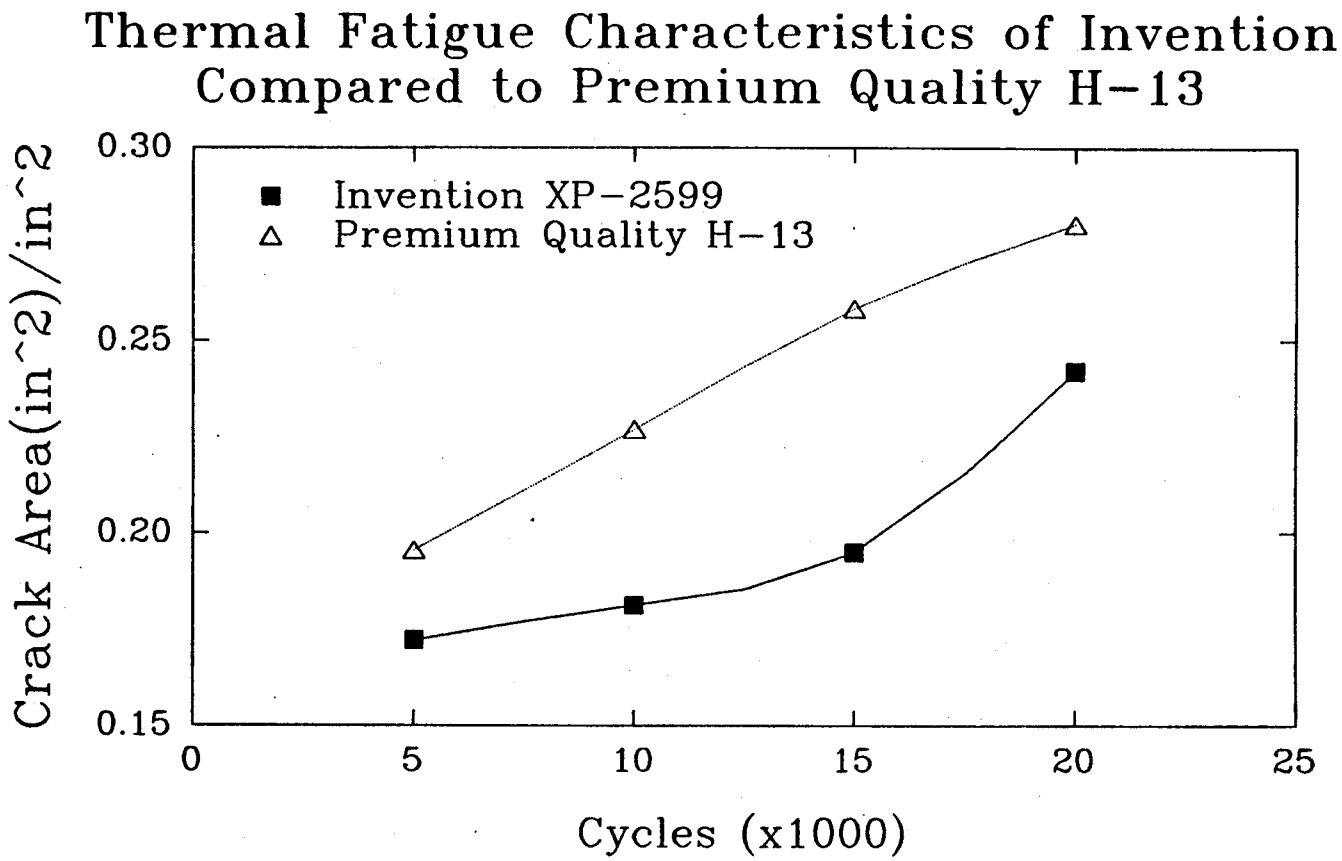
FIG. 4 is a graphical representation of the thermal fatigue curves of a steel composition of the invention compared with a premium quality H-13 steel plotting crack area versus cycles.
Figure 5:
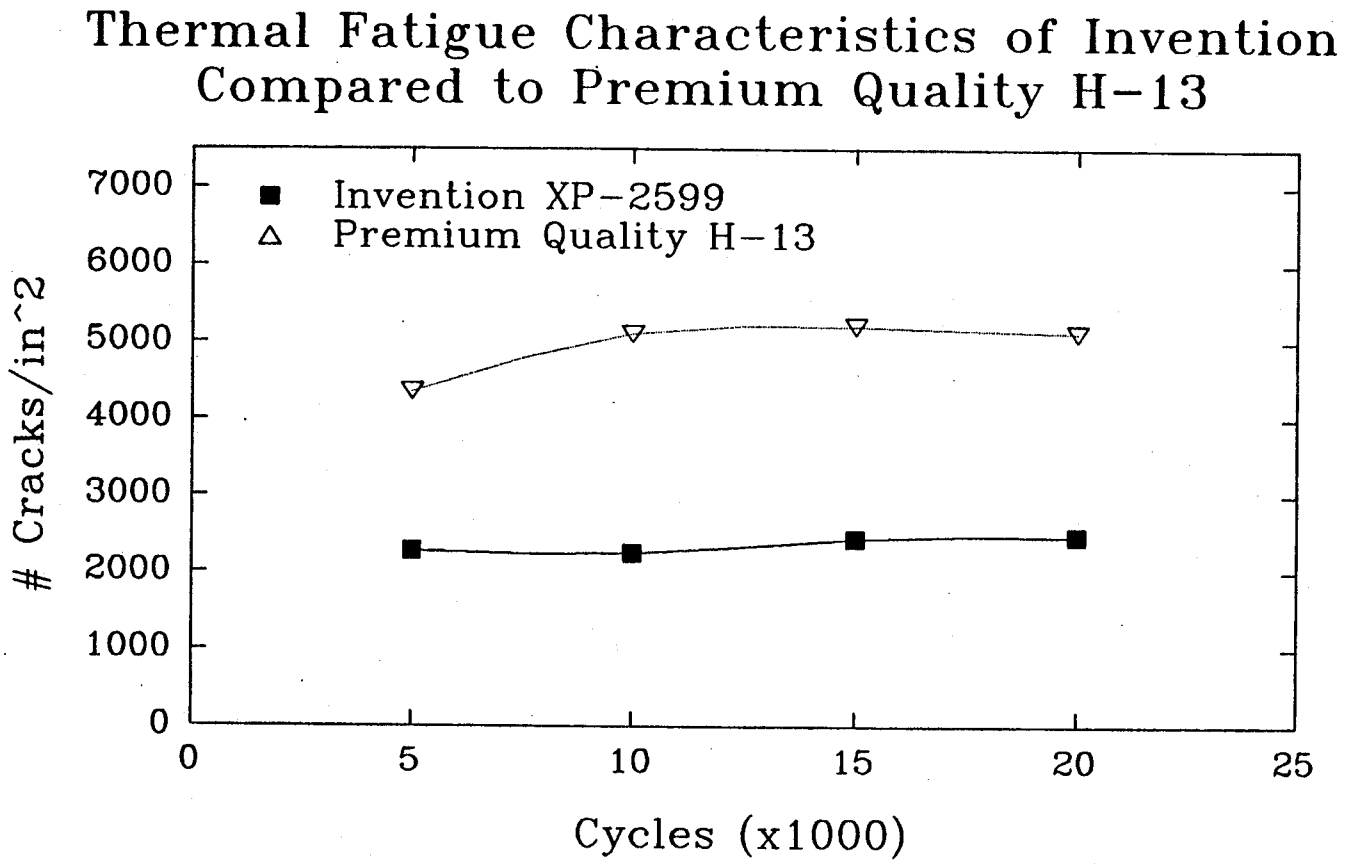
FIG. 5 is similar to FIG. 4, plotting number of cracks per square inch versus cycles.

FIGS. 4 and 5 depict the increased thermal fatigue resistance of Invention XP-2599 versus premium quality H-13. Longitudinal samples of both materials were heat treated at 1850° F. (1010° C.) for one (1) hour and air cooled and subsequently double tempered to a hardness of approximately 45 HRC. The samples were tested by introducing them into molten aluminum for a predetermined time when the area of interest reached a temperature between 900° F. and 1000° F. The samples were then removed from the molten aluminum bath and quenched into water. The samples were cycled a total to 20,000 times and were removed from the apparatus every 5000 cycles for measurements. The Invention XP-2599 resulted in a smaller total crack area as well as a lower number of cracks per square inches of area measured. This difference is indicative of improved heat check resistance which indicates that material according to the invention provide improved die life.

EXAMPLE 2

Figure 6:
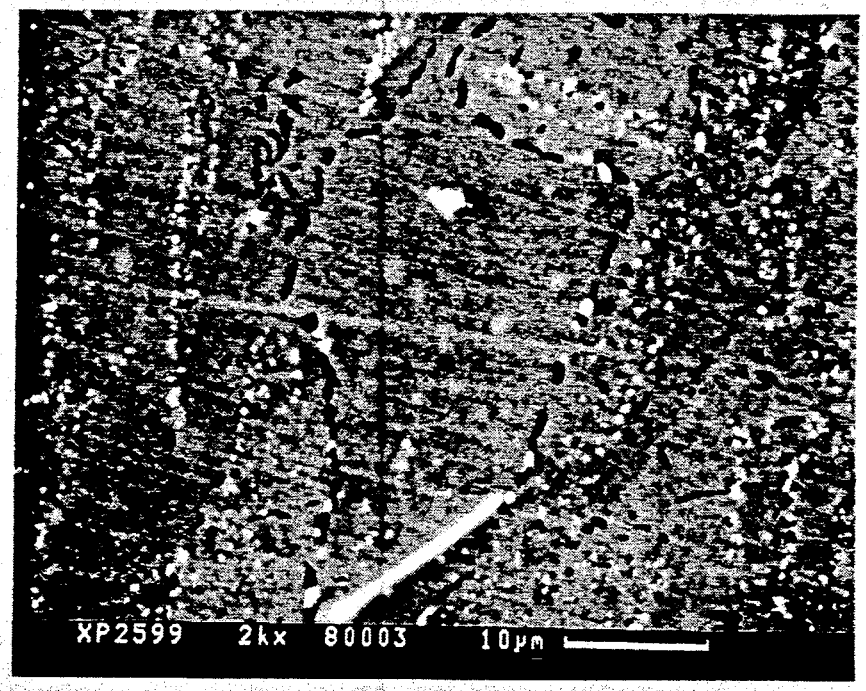
FIG. 6 is a photomicrograph of an alloy of the present invention at 2000 X magnification using a scanning electron microscope.
Figure 7:
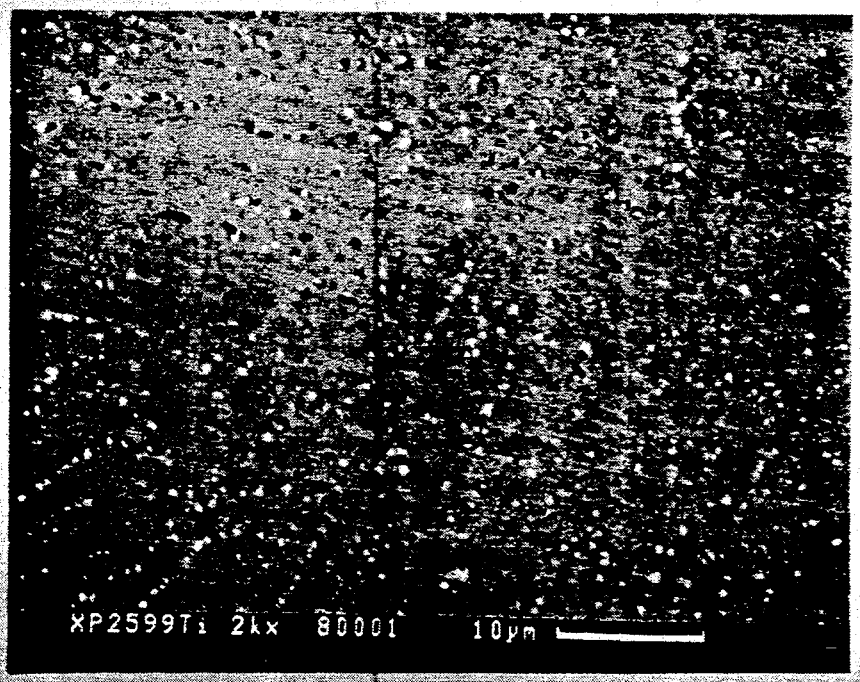
FIG. 7 is a photomicrograph of an alloy of the present invention, the same as in FIG. 6 but with a titanium addition, also made at 2000 X magnification.

A portion of the material produced in accordance with Example 1 was remelted and 0.03 weight % titanium (Ti) was added thereto. It was found that the titanium addition dramatically affected the size of the niobium particles. It is believed that titanium alters the activity of carbon and nitrogen in the liquid state to an extent such that niobium does not form large niobium carbides or carbonitrides. This beneficial effect is visually observed in FIGS. 6 and 7. FIG. 6 is a SEM photomicrograph at 2000 X magnification of the alloy of the present invention designated XP-2599 and having the composition of Example 1. FIG. 7 is a similar photomicrograph at the same magnification but of an alloy according to Example 2 having a titanium addition in the amount of 0.03 weight %. It is observed that FIG. 6 shows two relatively large white niobium particles and a dispersion of small white molybdenum carbide particles. FIG. 7 is noteworthy for the absence of large niobium particles and for the more uniform dispersion of fine molybdenum carbides. Thus, the effect of titanium additions can be readily appreciated.

Titanium also serves to increase certain physical properties of the material of the present invention. Table II indicates that the impact properties, reported by a standard Charpy-V notch impact test, are further improved through the addition of 0.03 weight % Ti to the already enhanced alloy of the invention, designated XP-2599 in the table.

TABLE II

| | Premium H-13 | | Air Melted XP2599 | | Remelted XP2599 | | Remelted XP2599 + Ti | |
|---|---|---|---|---|---|---|---|---|
| | Mid-Radius | Center | Mid-Radius | Center | Mid-Radius | Center | Mid-Radius | Center |
| CvN (ft-lbs) | 6.5 | 6.8 | 3.6 | 2.8 | 8.25 | 8.25 | 11.9 | 12.0 |

All samples were taken from the transverse orientation and heat treated as follows: 1850° F. (1010° C.)-1 hr-Air Cool and double tempered at 1100° F. (593° C.) resulting in a hardness of ≈45 HRC.

In summary, it will be appreciated that the modified H-13 hot work die steel of the invention, with the partial substitution of niobium for vanadium on production scale heats, greatly improves impact toughness. The closely controlled addition of niobium in micro-alloying amounts, most preferably less than 0.05 weight %, avoids the formation of large eutectic niobium carbide particles which ha heretofore caused problems by degrading toughness and by lessening the ability of the niobium to control grain growth. The micro-alloying addition of niobium results in the formation of small carbo-nitrides that effectively control grain size which eliminates the need for primary vanadium carbides heretofore required for grain boundary control. Therefore, the amount of vanadium necessary is only the amount that is soluble in the matrix at the austenitizing temperatures of 1010° C.–1066° C. (1850° F.–1950° F.). This vanadium forms secondary $V_4C_3$ carbides upon tempering which provide excellent elevated temperature hardness. The steel of the invention, as seen in FIG. 1, nearly doubles the upper shelf toughness of standard premium quality H-13, i.e., H-13 which has been remelted and homogenized. Heat check resistance is also greatly improved over premium quality H-13. The material of the invention is air hardenable using the same practices as employed in treating standard H-13.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A heat resistant steel having improved high temperature impact toughness and thermal fatigue resistance consisting of, in weight %:

| | |
|---|---|
| Carbon (C): | 0.32–0.45, |
| Manganese (Mn): | 0.20–0.50, |
| Silicon (Si): | 0.80–1.20, |
| Chromium (Cr): | 4.75–5.50, |
| Molybdenum (Mo): | 1.10–1.75, |
| Vanadium (V): | 0.30–0.55, |
| Niobium (Nb): | 0.02–0.09, |
| Titanium (Ti): | an effective amount up to 0.2, |
| Iron (Fe) and Incidental impurities: | Balance. |

2. The steel of claim 1 wherein the Niobium (Nb) content is between about 0.02–less than 0.05 weight %.

3. The steel of claim 1 wherein the Niobium (Nb) content is between about 0.02–0.035 weight %.

4. The steel of claim 1 consisting of in weight % about 0.37 C, 1.0 Si, 0.4 Mn, 5.3 Cr, 1.35 Mo, 0.38 V, 0.0035 Nb, balance Fe and incidental impurities.

5. The steel according to claim 1 which is remelted and homogenized.

6. A heat resistant steel having improved high temperature impact toughness and thermal fatigue resistance consisting essentially of, in weight %:

| | |
|---|---|
| Carbon (C): | 0.32–0.45, |
| Manganese (Mn): | 0.20–0.50, |
| Silicon (Si): | 0.80–1.20, |
| Chromium (Cr): | 4.75–5.50, |
| Molybdenum (Mo): | 1.10–1.75, |
| Vanadium (V): | 0.30–0.55, |
| Niobium (Nb): | 0.02–0.09, |
| Titanium (Ti): | 0.01–0.20, |
| Iron (Fe) and Incidental impurities: | Balance; |

said steel being subject to a remelting and homogenization treatment.

7. A process for producing a heat resistant steel having improved high temperature impact toughness and thermal fatigue resistance comprising the steps of:

providing a steel consisting of, in weight %:

| | |
|---|---|
| Carbon (C): | 0.34–0.40, |
| Manganese (Mn): | 0.25–0.45, |
| Silicon (Si): | 0.85–1.15, |
| Chromium (Cr): | 5.00–5.40, |
| Molybdenum (Mo): | 1.20–1.50, |
| Vanadium (V): | 0.30–0.52, |
| Titanium (Ti): | an effective amount up to 0.2, |
| Niobium (Nb): | 0.02–0.09, |
| Titanium (Ti): | an effective amount up to 0.2, |
| Iron (Fe) and Incidental impurities: | Balance; |

remelting said steel;

homogenizing said remelted steel; and hot working said remelted and homogenized steel.

8. The process of claim 7 wherein the provided steel is subjected to an argon-oxygen decarburization (AOD) refining step prior to said remelting step.

9. A heat resistant steel having improved high temperature impact toughness and thermal fatigue resistance consisting of, in weight %:

| | |
|---|---|
| Carbon (C): | 0.37, |
| Manganese (Mn): | 0.4, |
| Silicon (Si): | 1.0, |
| Chromium (Cr): | 5.3, |
| Molybdenum (Mo): | 1.35, |
| Vanadium (V): | 0.38, |
| Niobium (Nb): | 0.035, |
| Titanium (Ti): | 0.03, |
| Iron (Fe) and Incidental impurities: | Balance. |

10. A process for producing a heat resistant steel having improved high temperature impact toughness and thermal fatigue resistance comprising the steps of:

providing a steel consisting of, in weight %:

| | |
|---|---|
| Carbon (C): | 0.34–0.40, |
| Manganese (Mn): | 0.25–0.45, |
| Silicon (Si): | 0.85–1.15, |
| Chromium (Cr): | 5.00–5.40, |
| Molybdenum (Mo): | 1.20–1.50, |
| Vanadium (V): | 0.30–0.52, |
| Niobium (Nb): | 0.02–0.09, |
| Titanium (Ti): | 0.01–0.20, |
| Iron (Fe) and Incidental impurities: | Balance; |

remelting said steel;

homogenizing said remelted steel; and hot working said remelted and homogenized steel.

11. The process of claim 10 wherein the provided steel is subjected to an argon-oxygen decarburization (AOD) refining step prior to said remelting step.

* * * * *

UNITED STATES PATENT AND TRADEMARK OFFICE

CERTIFICATE OF CORRECTION

PATENT NO. : 5,207,843

DATED : May 4, 1993

INVENTOR(S) : James L. Maloney, William P. Edwards and Mark S. Rodney

It is certified that error appears in the above-identified patent and that said Letters Patent is hereby corrected as shown below:

Column 6 Line 58 "ha" should read --has--.

Claim 4 Line 40 Column 7 "0.0035" should read --0.035--.

Claim 7 Line 12 Column 8 delete "Titanium (Ti): an effective amount up to 0.2,"

Signed and Sealed this

Fourth Day of January, 1994

*Attest:*

Bruce Lehman

BRUCE LEHMAN

*Attesting Officer*

*Commissioner of Patents and Trademarks*